United States Patent [19]

Fukasawa et al.

[11] 4,345,987

[45] Aug. 24, 1982

[54] COATED ELECTRODE AND A METHOD OF ITS PRODUCTION

[75] Inventors: Akira Fukasawa; Minoru Ueda, both of Ibaragi, Japan

[73] Assignee: Agency of Industrial Science & Technology, Tokyo, Japan

[21] Appl. No.: 227,688

[22] Filed: Jan. 23, 1981

[30] Foreign Application Priority Data

Apr. 16, 1980 [JP] Japan ..... 55-50773

[51] Int. Cl.[3] ..... C25B 11/16; C25C 7/02; H01M 4/02

[52] U.S. Cl. ..... 204/290 R; 429/228; 429/245

[58] Field of Search ..... 204/290 R, 293; 429/219, 245, 228

[56] References Cited

U.S. PATENT DOCUMENTS

| | | | |
|---|---|---|---|
| 3,616,323 | 10/1971 | Covitz | 204/78 |
| 3,644,182 | 2/1972 | Wittel | 204/26 |
| 4,064,035 | 12/1977 | Fukawasa | 204/290 R |

*Primary Examiner*—F. Edmundson

*Attorney, Agent, or Firm*—Armstrong, Nikaido, Marmelstein & Kubovcik

[57] ABSTRACT

A coated electrode having excellent electric conductivity and resistance against corrosion is obtained by electrodepositing lead dioxide on the surface of an alloy which consists of lead and silver.

Prior to electrodepositing lead dioxide, the alloy is anodically oxidized beforehand in a solution of sulfate such that the surface of the alloy is oxidized. This enables the lead dioxide to be electrodeposited even in an acidic electrolyte.

5 Claims, No Drawings

COATED ELECTRODE AND A METHOD OF ITS PRODUCTION

BACKGROUND OF THE INVENTION

The present invention relates to a coated electrode which is obtained by coating an alloy composed of lead and silver with lead dioxide (hereinafter abbreviated as $PbO_2$).

Cathodes used for the electrolytic refining, electrolysis of salt water, and electrolytic processing of industrial waste water, must have a good electric conductivity as well as an excellent resistance against corrosion. The electrode which is composed of an electrically conductive material such as metal coated with a thin layer of $PbO_2$, satisfies the above-mentioned requirements and features reduced weight. The ordinary metals, however, easily develop a film of oxide on the contacting surface which contacts to the layer of $PbO_2$. Further, since the contact resistance is remarkably great between the metal and $PbO_2$, it becomes difficult to flow an electric current. Therefore, a particular attempt has been made to impart a high electric conductivity to a coated-type lead dioxide electrode which has a metallic substrate. For example, Japanese Patent Publication No. 23947/76 discloses an electrode obtained by electrodepositing $PbO_2$ on the surface of a silver substrate or a metal substrate plated with silver. This electrode has a very small contact resistance between the metal substrate and the $PbO_2$ coating. That is, it is possible to directly flow a current from the metal substrate which exhibits good electric conductivity. Further, the electrode exhibits a sufficient resistance against corrosion when it is used for the electrolytes containing halogen, sulfides, chromates and carbonates that form sparingly soluble silver compounds, or for the alkaline electrolytes.

When the electrode is used in the electrolytes other than the above-mentioned electrolytes for extended periods of time, however, it often becomes difficult to flow the electric current from the substrate being caused by the fact that silver elutes out at a small rate onto the $PbO_2$ layer through pores that reach the silver surface, and that there exists a gap between the substrate and the $PbO_2$ layer.

Another defect of the coated electrode employing silver substrate or silver-plated substrate is that when $PbO_2$ is to be electrodeposited on the silver substrate, it is allowed to use only the alkaline electrolyte to prevent silver from being anodically dissolved, and that when the silver-plated substrate is to be used, it is required to increase the thickness of the plated layer to increase the electric conductivity, requiring increased cost.

It has been attempted to electrodeposit the $PbO_2$ layer on the substrate made of pure lead. In this case, however, it is observed that the $PbO_2$ layer peels off from the substrate during the step of electrodeposition or when the coated electrode is being used. The cause is attributed to that heat is generated due to a very large electric resistance at the contact surface between the lead substrate and the $PbO_2$ layer, and stress is generated due to difference in the thermal expansion such that the layer is peeled off from the substrate, and that the electrolyte infiltrates through the clearance to corrode the lead substrate.

SUMMARY OF THE INVENTION

A major object of the present invention is to provide coated electrode having an excellent electric conductivity and an excellent resistance against corrosion, as well as to provide a method of its production.

Another object of the present invention is to provide an inexpensively constructed $PbO_2$-coated electrode which exhibits a small contact resistance between the metal substrate and the $PbO_2$ layer, as well as to provide a method of its production.

A further object of the present invention is to provide a coated electrode consisting of an alloy of lead and silver, of which the surfaces are coated with $PbO_2$.

A still further object of the present invention is to provide a method of producing coated electrodes by electrodepositing $PbO_2$ on the surfaces of an alloy composed of lead and silver.

Yet another object of the present invention is to provide a method of producing coated electrodes by oxidizing the surfaces of the alloy beforehand $PbO_2$ is electrodeposited on the surfaces of the alloy, and then electrodepositing $PbO_2$ on the surfaces of the alloy.

DETAILED DESCRIPTION OF THE INVENTION

The alloy of lead and silver used for the present invention can be prepared by any method and in any form. Namely, the alloy may be formed into an electrode substrate of any shape by casting or machining. Or, the alloy may be plated or coated on any other suitable substrates to form electrode substrates. From the viewpoint of resistance against corrosion and of cost, the alloy should contain silver in small amounts. From the viewpoint of electric conductivity, on the other hand, the alloy should contain silver in large amounts.

The contact resistance between the alloy substrate and the $PbO_2$ coating affects the electric conductivity of the electrode and resistance against corrosion. The contact resistance decreases with the increase in the silver content in the alloy substrate.

When the silver content is too great, however, the resistance against corrosion is decreased in case the $PbO_2$ layer contains pores. After all, the silver content should practically range from 3 to 35%, and preferably from 5 to 15%. Impurities that are usually contained in the alloys do not cause the contact resistance to be increased relative to the $PbO_2$ layer or do not deteriorate resistance against corrosion. Examples of the metal of this kind include iron, nickel, cobalt, manganese and tin.

The coated electrode of the present invention must have $PbO_2$ which is coated on the surface of the alloy composed of silver and lead. Although there is no particular limitation on the method of coating $PbO_2$, the best method will be to effect the electrodeposition in an electrolyte. The electric resistance between the alloy and the $PbO_2$ layer can be reduced to almost zero by electrodepositing $PbO_2$ on the silver-lead alloy.

According to the present invention, the thickness of the $PbO_2$ layer ranges from 0.005 to 5 mm, and preferably from 0.1 to 3 mm.

There is no particular limitation with regard to the electrolyte that is used for electrodepositing $PbO_2$ on the alloy substrate. Only the alkaline electrolyte is permitted to be used when the substrate metal is silver. With the silver-lead alloy of the present invention, however, it is permitted to effect the electrodeposition by using not only the alkaline electrolyte but also using such an electrolyte that may cause the anode to be dissolved when silver to lead alone is used, provided the alloy has been insolubilized beforehand. For instance, silver dissolves in a lead nitrate solution that is generally used for electrodepositing $PbO_2$. However, if the silver-lead alloy is subjected to the anodic oxidation in a solution of sulfate beforehand, the $PbO_2$ layer is formed on the whole surfaces of the silver-lead alloy, which makes it possible to electrodeposit $PbO_2$ in a bath of lead nitrate.

The greatest effect of the present invention is to markedly increase the resistance against corrosion of the $PbO_2$-coated electrode which contains silver without impairing the electric conductivity. With the conventional electrodes using silver as a substrate, silver often eluted out from the pores. Therefore, it was attempted to form a thick layer of $PbO_2$ in order to eliminate pores that may reach silver. According to the present invention, however, the substrate has good resistance against corrosion, and the $PbO_2$ layer must be formed in a reduced thickness. Consequently, the electrode according to the present invention can be manufactured at a relatively low cost and weighing less. The conventional thick film of $PbO_2$ endures over extended periods of time even under severe conditions such as in an aqueous solution of pure sulfuric acid. Thus, the resistance against corrosion increases probably because the solubility product of lead sulfate is $1.8\times10^{-8}$ relative to that of silver sulfate of $1.2\times10^{-5}$, which is a decrease of 1000 times.

According to the method of the present invention as mentioned above, the electrolyte for electrodepositing $PbO_2$ can be freely selected unlike when silver alone is used as the substrate. This means that the properties of the $PbO_2$ layer can be changed and adjusted depending upon the kind of electrolyte, and the $PbO_2$-coated electrode can be obtained having properties that meet desired applications. For example, a rigid $PbO_2$-coated layer of the $\alpha$-type having no stress of electrodeposition under particular conditions can be obtained from the alkaline lead electrolyte like the case of silver, and a $\beta$-$PbO_2$ layer having more excellent resistance against corrosion and electric conductivity can be obtained from the bath of lead nitrate.

Use of the silver-lead alloy is advantageous as compared with the use of silver alone not only with regard to its cost, but also with regard to recent skyrocketing price of silver.

Furthermore, when the electrode substrate is to be constructed by coating the silver-lead alloy on a suitable substrate, the increase in the thickness of the alloy layer does not become so expensive as the plating of silver. Accordingly, the electric conductivity is markedly increased.

The $PbO_2$ electrode was used as insoluble anode for electrolytic oxidation of halogenate and chromate. The $PbO_2$-coated electrode according to the method of the present invention weighs considerably less and costs less than the conventional counterparts, and exhibits excellent electric conductivity and resistance against corrosion. Therefore, the $PbO_2$-coated electrode of the present invention endures severe use such as the bath of sulfuric acid, and can be used as an insoluble anode for the electrolytic refining under strongly acidic conditions of sulfuric acid and for the electrolytic processing of industrial waste water.

The invention will be illustrated below in further detail by way of specific examples.

Example 1

[Oxidation of Anode]

Using a silver-lead alloy plate having a silver content of 10% as an anode and a lead plate of nearly the same size as a cathode, the electrolysis was effected at ordinary temperature in a solution containing 20% of sodium sulfate at an anode current density of about 1 amp/dm$^2$. Immediately after the current has been supplied, the surface of the anode got a brownish color and formed bubbles. This was attributed to the fact that lead on the anode was subjected to electrolytic oxidation and converted into $PbO_2$ while water was subjected to the electrolysis. After the electrolysis was continued for several hours, the anode was completely coated with the $PbO_2$ layer.

[Electrodeposition of $PbO_2$]

Using the above-mentioned electrodes, the electrolysis was effected at a temperature of 40° C. using a solution containing 30% of lead nitrate at a current density of 4.0 amps/dm$^2$ for 3 hours. Little gas evolved from the anode surface composed of the alloy substrate coated with the $PbO_2$ layer; the surface of the anode of the alloy substrate was further electrodeposited with a black and rigid $PbO_2$ layer of a thickness of 0.5 mm.

The thus obtained $PbO_2$-coated electrode employing the alloy plate having a silver content of 10% as a substrate, exhibited no contact resistance between the substrate and the $PbO_2$ layer, exhibited good electric conductivity and sufficient resistance against corrosion for extended periods of time.

Example 2

A copper plate was immersed in a melting alloy consisting of lead and silver in an equal amount, such that a layer of alloy deposited on the copper plate. The thus plated copper plate was used as an electrode substrate. The electrode substrate which serves as an anode and a steel plate which serves as a cathode were opposed to each other maintaining a distance of 5.0 cm in a solution of sodium hydroxide of 5.0 N, which was saturated with lead oxide. The electrolysis was effected at an anode current density of 2.0 amps/dm$^2$ and at a liquid temperature of 60° C. The surface of the anode was coated with black $PbO_2$, of which the thickness increased in proportion to the amount of current and reached 0.2 mm after 2 hours have passed.

The electrode used copper substrate. However, since the surface of copper had been coated with the silver-lead alloy, there was no contact resistance between copper and $PbO_2$. Further, since copper had been completely protected with the silver-lead alloy which has resistance against corrosion, the thickness of the $PbO_2$ layer could be reduced.

Example 3 and Comparative Example

A half of a metal plate having a thickness of 1.0 mm, a width of 2.0 cm and a length of 20 cm was subjected to the following three kinds of processings to prepare a substrate. Each of the substrates was coated with the $PbO_2$ layer to examine the resistance against corrosion. Namely, there were prepared a silver-lead alloy-coated metal titanium plate (A) which was obtained by applying a silver-lead alloy having a silver content of 11% onto the metal titanium, a silver-plated titanium plate (B) obtained by plating silver on the metal titanium, and a cleaned plate (C) of metal lead. The $PbO_2$ layer was electrodeposited under the same conditions as in Example 2. In order to shorten the testing time, the anti-corrosion test was carried out by selecting the thickness of the $PbO_2$ layer to be as small as 0.2 mm under such severe conditions as in the 3.3 N sulfuric acid, at an anode current density of 5.0 amps/dm$^2$ and a liquid temperature of 45° C.

The time until ordinary bath voltage of about 3 volts suddenly rose to 15 volts or greater was measured, and was indicated as anti-corrosion time. Further, ratios of electric resistances of the electrodes coated with $PbO_2$ to the electric resistances of the substrates of the electrodes A, B and C, were indicated as resistance ratios. As will be understood from Table below, the anti-corrosion time of the electrode A was greater by 13 times than that of the electrode B. The electrode A exhibits a resistance ratio which is slightly greater than that of the electrode B, because the layer of silver-lead alloy of the electrode A has the same thickness as that of the silver layer of the electrode B.

Alloy is cheaper than silver. Therefore, if the thickness of the alloy layer is selected to be far greater than the thickness of the silver layer, the resistance of the electrode A can be greatly reduced to satisfy practical needs.

The electrode C exhibits electric resistance which is considerably greater than that of the substrate since the contact resistance is very great between lead and the $PbO_2$ layer. With the electrode C, furthermore, the $PbO_2$ layer is locally peeled off during the experiment, that does not happen with the electrodes A and B. Therefore, the anti-corrosion time of the electrode C is nearly the same as that of the electrode B.

| Substrate | Anti-corrosion time (hr) | Resistance ratio |
|---|---|---|
| A | 480 | 0.87 |
| B | 36 | 0.31 |
| C | 44 | 15.9 |

What is claimed is:

1. A coated electrode in which lead dioxide is coated on the surface of an alloy which consists of lead and silver.

2. An electrode according to claim 1, wherein the silver content of the alloy is 3 to 35%.

3. An electrode according to claim 1, wherein the silver content of the alloy is 5 to 15%.

4. An electrode according to claim 1, wherein the thickness of the coating of lead dioxide is from 0.05 to 5 mm.

5. An electrode according to claim 1, wherein the thickness of the coating of lead dioxide is from 0.1 to 3 mm.

* * * * *